US011852344B2

(12) United States Patent
Gralki et al.

(10) Patent No.: US 11,852,344 B2
(45) Date of Patent: Dec. 26, 2023

(54) TUBULAR COMBUSTION CHAMBER SYSTEM AND GAS TURBINE UNIT HAVING A TUBULAR COMBUSTION CHAMBER SYSTEM OF THIS TYPE

(71) Applicant: Siemens Aktiengesellschaft, Munich (DE)

(72) Inventors: Matthias Gralki, Mulheim an der Ruhr (DE); Claus Krusch, Essen (DE); Daniel Schmidt, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 17/440,354

(22) PCT Filed: Mar. 3, 2020

(86) PCT No.: PCT/EP2020/055501

§ 371 (c)(1),
(2) Date: Sep. 17, 2021

(87) PCT Pub. No.: WO2020/200609

PCT Pub. Date: Oct. 8, 2020

(65) Prior Publication Data

US 2022/0186928 A1 Jun. 16, 2022

(30) Foreign Application Priority Data

Apr. 1, 2019 (DE) ..... 10 2019 204 544.8

(51) Int. Cl.
*F23R 3/02* (2006.01)
*F23R 3/00* (2006.01)

(52) U.S. Cl.
CPC ..... *F23R 3/02* (2013.01); *F23R 3/007* (2013.01)

(58) Field of Classification Search
None
See application file for complete search history.

(56) References Cited

U.S. PATENT DOCUMENTS 2,567,079 A 9/1951 Morgan
3,981,142 A * 9/1976 Irwin ..... F23R 3/007 60/753

(Continued)

FOREIGN PATENT DOCUMENTS

DE 0767329 A1 * 9/1997 ..... F16J 15/08
EP 1528343 A1 5/2005

(Continued)

OTHER PUBLICATIONS

PCT International Search Report and Written Opinion of International Searching Authority dated Jun. 2, 2020 corresponding to PCT International Application No. PCT/EP2020/055501 filed Mar. 3, 2020.

*Primary Examiner* — Craig Kim
(74) *Attorney, Agent, or Firm* — Wolter Van Dyke Davis, PLLC

(57) ABSTRACT

A tubular combustion chamber system for a gas turbine unit includes a plurality of annularly arranged transition lines, which are designed to be connected at the upstream ends thereof to respective burners and to conduct hot gas produced by the burners to a turbine. The tubular combustion chamber system has a hot gas distributor, which is designed to be connected to the turbine and defines a ring channel, which is open to the turbine and into which the downstream ends of the transition lines lead. A gas turbine unit includes a plurality of annularly arranged burners, a turbine and a tubular combustion chamber system which connects the burners to the turbine.

11 Claims, 2 Drawing Sheets

(56) References Cited

U.S. PATENT DOCUMENTS 4,373,326 A * 2/1983 Smale ..... F02C 3/10 60/791
4,988,290 A * 1/1991 Forster ..... F02F 3/12 432/118
5,706,646 A * 1/1998 Wilde ..... F01D 9/023 60/752
6,508,052 B1 * 1/2003 Snyder ..... F02C 7/052 55/306
7,540,710 B2 6/2009 Grote et al.
8,402,764 B1 * 3/2013 Liang ..... F01D 9/023 60/755
9,618,207 B1 4/2017 Wiebe
9,650,904 B1 5/2017 Wiebe
9,702,258 B2 * 7/2017 Mayer ..... F01D 25/28
9,803,487 B2 10/2017 Wiebe
11,371,705 B2 * 6/2022 Sadasivuni ..... F23R 3/46
2001/0032453 A1 * 10/2001 Tatsumi ..... F23R 3/007 60/752
2005/0132708 A1 * 6/2005 Martling ..... F01D 9/023 60/752
2009/0071160 A1 * 3/2009 Keller ..... F01D 9/023 60/753
2009/0181257 A1 * 7/2009 Grote ..... C04B 41/5031 427/372.2
2009/0260364 A1 10/2009 Keller et al.
2010/0077719 A1 4/2010 Wilson et al.
2012/0177487 A1 * 7/2012 Headland ..... F01D 9/023 415/196
2013/0219853 A1 * 8/2013 Little ..... F02C 3/145 60/200.1
2013/0239585 A1 9/2013 Morrison
2014/0000265 A1 * 1/2014 Simo ..... F01D 9/023 60/752
2014/0007578 A1 * 1/2014 Genin ..... F23R 3/346 60/737
2015/0198054 A1 7/2015 Charron et al.
2016/0146026 A1 * 5/2016 Hicks ..... F01D 9/023 415/222
2017/0276001 A1 * 9/2017 McMahan ..... F01D 9/023
2017/0276071 A1 * 9/2017 Flanagan ..... F23R 3/46
2017/0284675 A1 * 10/2017 North ..... F23R 3/46
2018/0085869 A1 * 3/2018 Gattermeyer ..... F01D 9/023
2018/0106155 A1 * 4/2018 Schiavo ..... F23R 3/007
2018/0340687 A1 * 11/2018 Morrison ..... F01D 9/023
2020/0141586 A1 * 5/2020 Igarashi ..... F02C 7/28
2020/0277868 A1 * 9/2020 Hucker ..... F01D 9/023
2021/0102705 A1 * 4/2021 Kramer ..... F23R 3/60
2021/0190319 A1 6/2021 Gralki
2022/0186928 A1 * 6/2022 Gralki ..... F01D 9/023
2023/0072067 A1 * 3/2023 Wajnikonis ..... E21B 17/046

FOREIGN PATENT DOCUMENTS

EP 2660424 A1 * 11/2013 ..... F01D 5/145
EP 3486431 A1 * 5/2019 ..... F01D 9/023
JP 2014009938 A * 1/2014 ..... F01D 9/023
WO WO-2020086069 A1 * 4/2020

* cited by examiner

TUBULAR COMBUSTION CHAMBER SYSTEM AND GAS TURBINE UNIT HAVING A TUBULAR COMBUSTION CHAMBER SYSTEM OF THIS TYPE

CROSS REFERENCE TO RELATED APPLICATIONS

This application is the US National Stage of International Application No. PCT/EP2020/055501 filed 3 Mar. 2020, and claims the benefit thereof. The International Application claims the benefit of German Application No. DE 10 2019 204 544.8 filed 1 Apr. 2019. All of the applications are incorporated by reference herein in their entirety.

FIELD OF INVENTION

The present invention relates to a tubular combustion chamber system for a gas turbine unit, having a plurality of annularly arranged transition ducts designed to be connected by their upstream ends in each case to a burner and to conduct hot gas produced by the burners to a turbine. The present invention further relates to a gas turbine unit having a plurality of annularly arranged burners, a turbine and a tubular combustion chamber system of the type described above that connects the burners to the turbine.

BACKGROUND OF INVENTION

Tubular combustion chamber systems of the abovementioned type are employed in gas turbine units to conduct hot gas from the burners to the turbine entrance. For this purpose they comprise transition ducts which are configured as pipelines and which among those skilled in the art are also referred to as "transitions". During operation of the gas turbine unit, there are high thermal stresses on the transition ducts. They are made, accordingly, of high-temperature-resistant materials. Typically they are fabricated from thin-wall nickel-based materials with internal cooling channels and an internal layer system for heat insulation (TBC+ MCrAlY). In the region of the interface to the turbine entrance, sealing systems are provided in order to reduce the leakage of compressed air into the combustion system and to permit relative movements between the tubular combustion chamber system and the turbine and also between the individual transition ducts. Because of the implementation of the sealing systems and because of the mechanical degrees of freedom of the interface between the transition ducts and the turbine, the lateral seals, on the one hand, are subject to severe abrasive wear. On the other hand, there is also wear to the transition ducts and their internal layer system owing to the high thermal loading, primarily in the exit region, as a consequence of layer aging and sealing groove wear. A further factor is that the flow impinging on the turbine is uneven as an inherent result of the system, owing to the circumferentially noncontinuous inflow cross section at the interface between the transition ducts and the turbine. An effect of the uneven flow impingement caused by the shadow effect of the side walls and seals of the exit region of the transition ducts are high-frequency changes in temperature and velocity, with adverse consequences for the lifetime of the turbine blades.

The lifetime of the transition ducts is limited by the layer system and the seals to the turbine. The internal cooling channels are fabricated by assembly of multiple sheets, and therefore entails very high cost and complexity. Additive manufacture has proved impossible so far because of the limits on the size/volume of available 3D printers. At reprocessing, it is regularly necessary for the exit region of the transition ducts in particular to be removed and renewed. Reprocessing further comprises the stripping of the entire layer system, and recoating. The costs of this complicated processing are therefore close to the costs of the new components.

The life cycle costs of new or existing gas turbine units are determined primarily by the lifetimes and maintenance intervals of the hot gas components. With regard to the combustion system, considerably longer maintenance intervals in the face of thermal stress which is increased at the same time are required for new gas turbine units. As a result there is demand for structural solutions which eliminate or at least significantly ameliorate the weak points of current designs.

SUMMARY OF INVENTION

Starting from this prior art, it is an object of the present invention to provide a tubular combustion chamber system of the abovementioned type that features improved design.

In order to achieve this object, the present invention provides a tubular combustion chamber system of the abovementioned type which is characterized in that it has a hot gas manifold which is designed for connection to the turbine and which defines an annular channel, open to the turbine, into which there open the downstream ends of the transition ducts. An additional hot gas manifold of this kind between the transition ducts and the turbine entrance results in a very uniform flow impingement of the turbine, thereby significantly reducing high-frequency changes in temperature and velocity. This is very beneficial to the lifetime of the turbine blades.

According to one embodiment of the present invention, the transition ducts and the hot gas manifold are made of metal and are provided internally with a refractory lining, more particularly with a ceramic lining. A lining of this kind significantly reduces the thermal stress on the metallic components, i.e., the hot gas manifold and the transition ducts. The smaller differences in expansion associated with this reduction, in the region of the seals to the turbine and the seals between the transition ducts, result in less wear in this region and enable more robust assembly designs between the tubular combustion chamber system and the turbine. Furthermore, the refractory lining entails lower high-temperature requirements for the materials of the metallic components, so permitting cost savings to be made. Furthermore, by virtue of the lining, the transition ducts can be implemented without an internal layer system, so significantly reducing the outlay for maintenance and reprocessing, as there is no need for stripping and recoating of the transition ducts. Because a refractory lining is used, moreover, there is a reduction in the cooling requirement of the metallic components of the tubular combustion chamber system. In comparison to tubular combustion chamber systems without ceramic lining, the cooling air requirement, according to present calculations, can be lowered by up to 50%, with a consequent increase in the performance of the gas turbine unit.

The cross section of each transition duct advantageously tapers conically in the downstream direction, wherein the refractory lining of the transition duct has at least one annular lining section whose outer diameter tapers conically in the downstream direction, which is held on the transition duct with radial and axial pretension. By virtue of such pretension, which may be realized, for example, through the positioning of spring elements and/or damping elements between the refractory lining and the corresponding transition duct, differences in thermal expansion between the metallic transition ducts and their ceramic lining are compensated. More particularly the ceramic line is secured in a force-limited manner under all operating conditions.

According to one variant of the present invention, the at least one annular lining section may be formed by a single lining element, i.e., by an annular lining element with conical outer face.

According to a second variant, it is also possible to configure the at least one annular lining section as a plurality of ring segment-shaped lining elements which are braced against one another in the circumferential direction.

The refractory lining of the hot gas manifold advantageously has a multiplicity of lining elements which are attached with radial pretension to the radially inner and outer faces of the hot gas manifold. The lining elements of the hot gas manifold ought as far as possible to be installed with small gaps between the individual lining elements, in order to reduce the cooling air demand, this being made possible by the radial pretension.

The transition ducts and the hot gas manifold are advantageously made of a high-heat-resistant metal material, more particularly of a thin-wall, high-heat-resistant material in the manner of a sheet. The avoidance of nickel-based materials represents a key advantage of the system described.

Advantageously the outer circumferential side and/or the inner circumferential side of the hot gas manifold are/is provided with an attachment flange which is designed for attachment to the turbine. In this way a very simple construction is achieved.

The present invention further provides a gas turbine unit having a plurality of annularly arranged burners, a turbine and a tubular combustion chamber system according to the invention which connects the burners to the turbine.

BRIEF DESCRIPTION OF THE DRAWINGS

Further features and advantages of the present invention will be apparent from the description below of a tubular combustion chamber system according to one embodiment of the present invention, with reference to the appended drawing, in which.

DETAILED DESCRIPTION OF INVENTION

Figure 1:
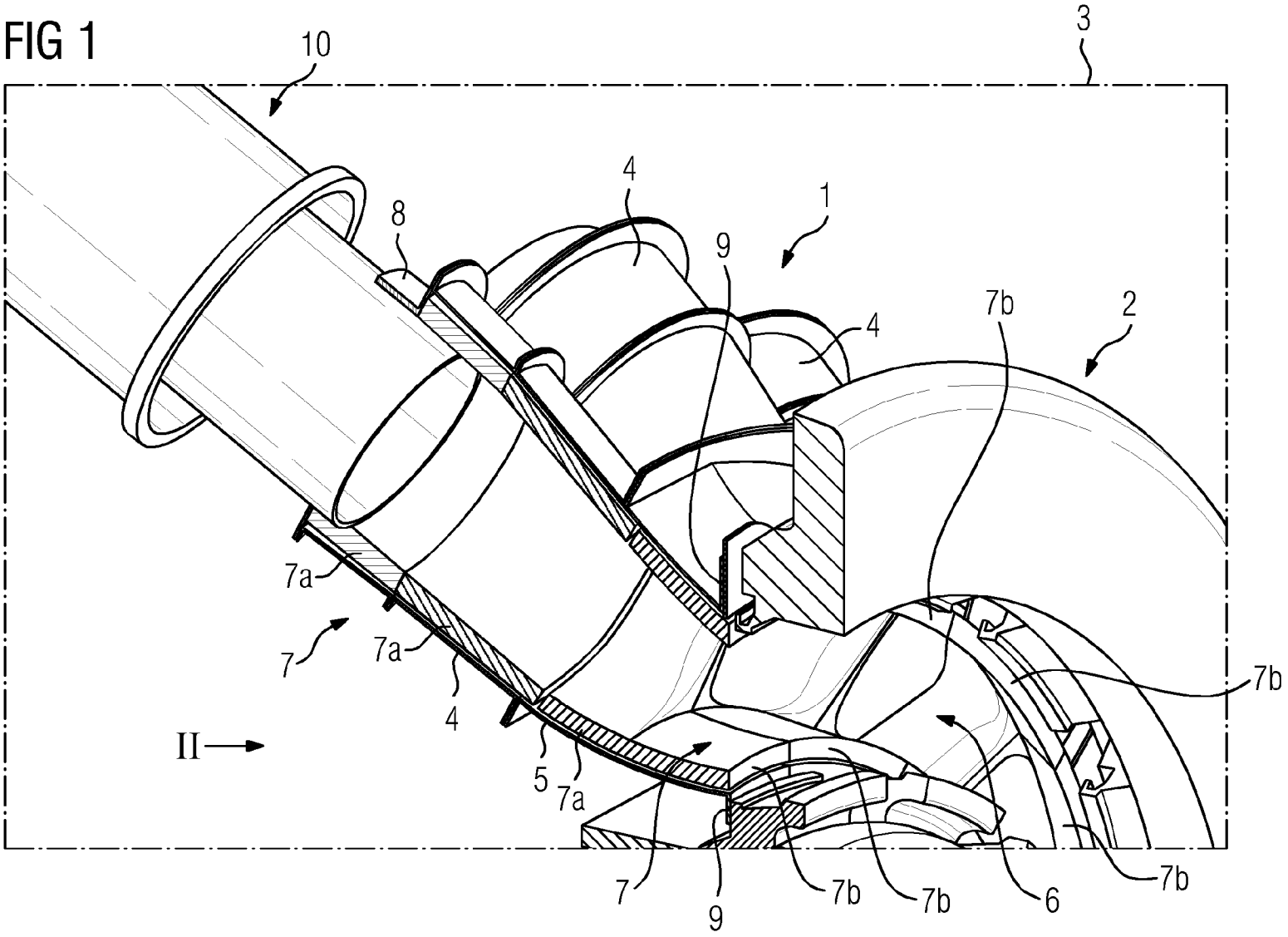
FIG. 1 shows a perspective partial view, in partial section, of a tubular combustion chamber system according to one embodiment of the present invention, connected to a turbine of a gas turbine unit.
Figure 2:
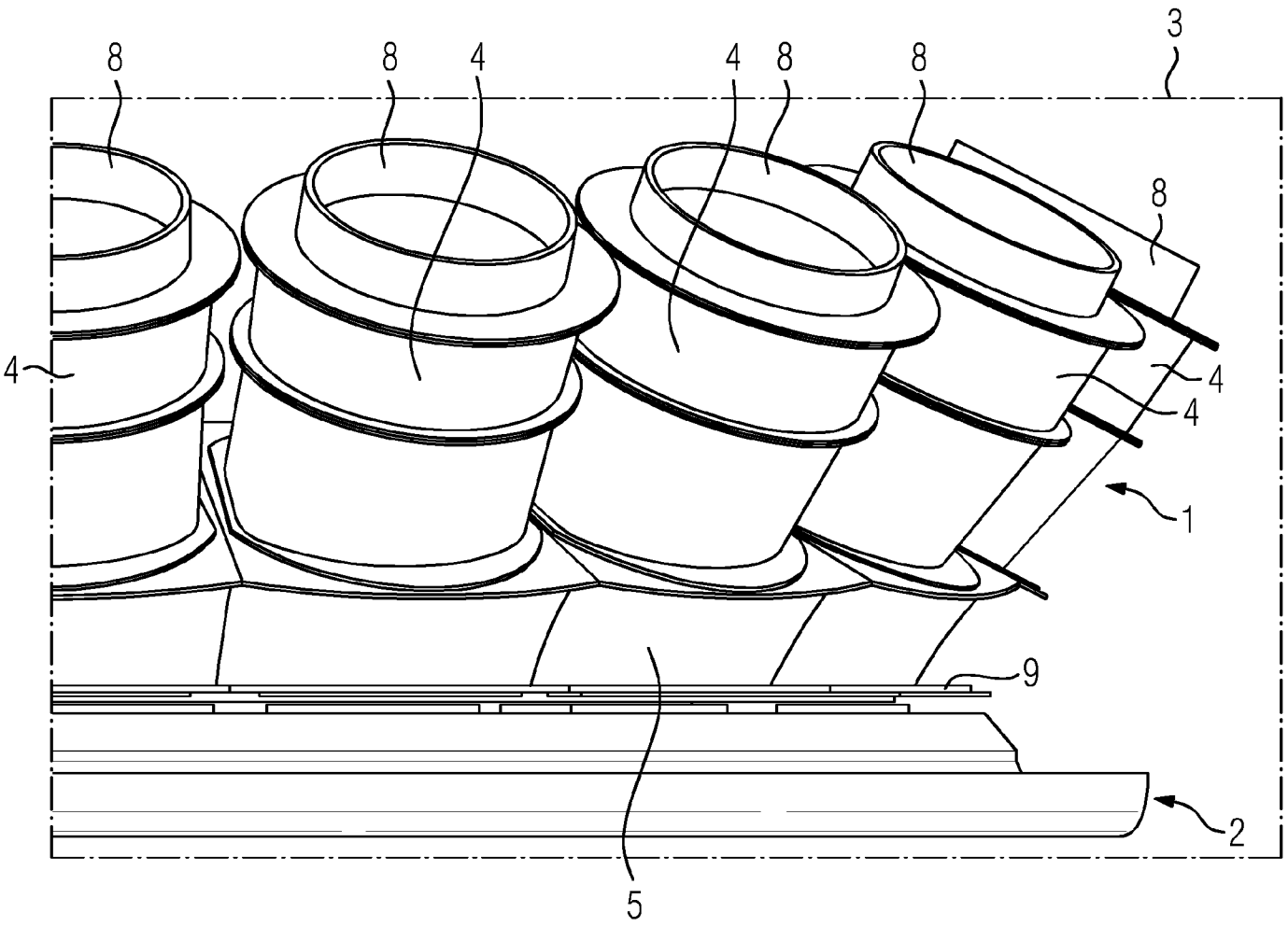
FIG. 2 shows a perspective view of the arrangement represented in FIG. 1, viewed in the direction of the arrow II in FIG. 1.

The figures show a tubular combustion chamber system 1 according to one embodiment of the present invention, connected to a turbine 2 of a gas turbine unit 3. The tubular combustion chamber system 1 comprises a plurality of annularly arranged transition ducts 4 which are designed to be connected by their upstream ends in each case to a burner 10 and to conduct hot gas produced by the burners 10 to the turbine 2; in FIG. 1, by way of example, only one individual burner 10 is shown. The tubular combustion chamber system 1 further comprises a hot gas manifold 5 which is designed for connection to the turbine 2 and which defines an annular channel 6, open to the turbine 2, into which there open the downstream ends of the transition ducts 4. The transition ducts 4 and the hot gas manifold 5 are made of metal, for example of a high-heat-resistant metal alloy. They each comprise a refractory lining 7, made advantageously of a ceramic material. The transition ducts 4 each have a cross section which tapers conically in the downstream direction. The refractory lining 7 of the transition ducts 4 comprises in each case a plurality of annular lining sections whose outer diameter tapers conically in the downstream direction, which presently are formed by annular lining elements 7*a*. Alternatively, however, it is also possible in principle for the annular lining sections to be formed in each case by a plurality of ring segment-shaped lining elements. The lining elements 7*a* of a transition duct 4 are inserted axially, starting from the upstream end of the transition duct 4, into the transition duct 4, with spring elements and/or damping elements, not shown in any more detail, being positioned along the circumference between the lining elements 7*a* and the inside wall of the transition duct 4, said elements being guided form-fittingly on the outer circumference of the lining elements 7*a* or on the inside wall of the transition duct 4. The conical configuration of the transition duct 4 and also of the lining elements 7*a* means that there is radial and also axial pretension of the lining elements 7*a* in such a way that they are held with radial and axial pretension on the transition duct 4. The tension is maintained presently by an annular pressure element 8 which is inserted into the transition duct 4 at the upstream end, is pressed against the end face of the adjacent lining element 7*a*, and then is attached to the transition duct 4 with generation of the desired pressing force. The attachment may be made, for example, by means of screws. The refractory lining 7 of the hot gas manifold 5 is realized by a multiplicity of lining elements 7*b*, which advantageously are attached likewise with radial pretension to the radially inner and outer faces of the hot gas manifold 5. To secure the tubular combustion chamber system 1 on the turbine 2, the outer circumferential side and the inner circumferential side of the hot gas manifold 5 are provided, on the free end of the hot gas manifold 5 facing the turbine 2, with attachment flanges 9 designed for attachment to the turbine 2 by means of screws.

The arrangement described above is advantageous in that, by virtue of the additional hot gas manifold 5 of the tubular combustion chamber system 1 according to the invention, the flow of hot gas impinging on the turbine 2 is very uniform, thus significantly reducing high-frequency changes in temperature and velocity. This is very beneficial for the lifetime of the turbine blades.

Further advantages are associated with the refractory lining 7 of the transition ducts 4 and of the hot gas manifold 5. This lining significantly reduces the thermal stress on the metallic components, i.e., the transition ducts 4 and the hot gas manifold 5. The smaller differences in expansion associated with this reduction, in the region of the seals to the turbine 2 and the seals between the transition ducts 4, result in less wear in this region and enable more robust assembly designs between the tubular combustion chamber system 1 and the turbine 2. Furthermore, the refractory lining 7 entails lower high-temperature requirements on the materials of the metallic components 4 and 5, thereby allowing cost savings to be made. By virtue of the lining 7, moreover, the transition ducts 4 can be implemented without an inner layer system, thereby significantly reducing the outlay for maintenance and reprocessing, since there is no need for stripping and recoating of the transition ducts 4. Furthermore, because of the use of a refractory lining 7, there is a reduction in the cooling demand of the metallic components 4 and 5 of the tubular combustion chamber system 1. In comparison to tubular combustion chamber systems without ceramic lining, the cooling air demand, according to present calculations, can be reduced by up to 50%, with a consequent increase in the performance of the gas turbine unit 3.

The invention, although having been described and illustrated in more detail through the exemplary embodiment, is nevertheless not limited by the examples disclosed, and other variations may be derived therefrom by the skilled person without departing the scope of protection of the invention.

The invention claimed is:

1. A tubular combustion chamber system for a gas turbine unit, comprising:

transition ducts which are arranged annularly about an axis and which are designed to be connected by their upstream ends in each case to a respective burner and to conduct hot gas produced by the burners to a turbine, and a hot gas manifold which is designed for connection to the turbine and which defines an annular channel that is open to the turbine and into which downstream ends of the transition ducts open, wherein radially inner and outer faces of the hot gas manifold that define the annular channel converge toward each other from an upstream end to a downstream end of the annular channel, wherein the transition ducts and the hot gas manifold are made of metal and are provided internally with a refractory lining, wherein a cross section of each transition duct tapers conically in a downstream direction, wherein a refractory lining of each transition duct comprises at least one annular lining section whose outer diameter tapers conically in the downstream direction and which is held on the transition duct with radial and axial pretension, wherein a refractory lining of the hot gas manifold comprises a multiplicity of manifold lining sections that are also prolongations of the downstream ends of the refractory linings of the transition ducts, and wherein an inlet and an outlet of a select transition duct and a respective inlet of the hot gas manifold are all disposed at a common clocking position about the axis.

2. The tubular combustion chamber system as claimed in claim 1, wherein the at least one annular lining section is formed by a single lining element.

3. The tubular combustion chamber system as claimed in claim 1, wherein the at least one annular lining section is formed by a plurality of ring segment-shaped lining elements which are braced against one another in a circumferential direction.

4. The tubular combustion chamber system as claimed in claim 1, wherein the multiplicity of manifold lining elements are attached with radial pretension to the radially inner and outer faces of the hot gas manifold.

5. The tubular combustion chamber system as claimed in claim 1, wherein a downstream end of an outer circumferential side and/or a downstream end of an inner circumferential side of the hot gas manifold are/is provided with an attachment flange configured to attach the hot gas manifold to the turbine.

6. A gas turbine unit comprising:

a plurality of annularly arranged burners, a turbine, and a tubular combustion chamber system as claimed in claim 1 that connects the burners to the turbine.

7. The tubular combustion chamber system as claimed in claim 1, wherein the refractory lining comprises a ceramic lining.

8. The tubular combustion chamber system as claimed in claim 1, wherein the metal comprises a thin-wall formed from a sheet.

9. The tubular combustion chamber system as claimed in claim 1, further comprising an annular pressure element secured to an upstream end of the transition duct and pressed against an end face of the refractory lining.

10. The tubular combustion chamber system as claimed in claim 1, wherein in the transition ducts the refractory lining continuously tapers from a point upstream of the hot gas manifold until reaching the hot gas manifold, and wherein in the hot gas manifold a radially outer side of the refractory lining continuously converges toward a radially inner side of the refractory lining in a direction from the upstream end to the downstream end of the annular channel.

11. A tubular combustion chamber system for a gas turbine unit, comprising:

transition ducts which are arranged annularly about an axis and which are designed to be connected by their upstream ends in each case to a respective burner and to conduct hot gas produced by the burners to a turbine, and a hot gas manifold which is designed for connection to the turbine and which defines an annular channel that is open to the turbine and into which downstream ends of the transition ducts open, wherein a cross section of each transition duct tapers conically in a downstream direction, wherein at a downstream end of each transition duct a refractory lining of each transition duct comprises at least one annular lining section whose outer diameter tapers conically in the downstream direction and which is held on the transition duct with radial and axial pretension, wherein a refractory lining of the hot gas manifold comprises a multiplicity of manifold lining sections that are also prolongations of the downstream ends of the refractory linings of the transition ducts, and wherein an inlet and an outlet of a select transition duct and a respective inlet of the hot gas manifold are all disposed at a common clocking position about the axis.

* * * * *